US006108948A

United States Patent [19]

Tozawa et al.

[11] Patent Number: 6,108,948

[45] Date of Patent: Aug. 29, 2000

[54] METHOD AND DEVICE FOR CONTROLLING CONSTRUCTION MACHINE

[75] Inventors: Shoji Tozawa; Tomoaki Ono, both of Tokyo, Japan

[73] Assignee: Shin Caterpillar Mitsubishi Ltd., Tokyo, Japan

[21] Appl. No.: 09/180,551

[22] PCT Filed: Nov. 28, 1997

[86] PCT No.: PCT/JP97/04362

§ 371 Date: Nov. 10, 1998

§ 102(e) Date: Nov. 10, 1998

[87] PCT Pub. No.: WO98/40570

PCT Pub. Date: Sep. 17, 1998

[30] Foreign Application Priority Data

Mar. 10, 1997 [JP] Japan ..... 9-055344

[51] Int. Cl.[7] ..... E02F 9/20

[52] U.S. Cl. ..... 37/348; 172/2

[58] Field of Search ..... 37/348; 60/413, 60/414, 417, 454; 91/511; 172/2, 3, 4, 4.5, 7, 9, 431, 435; 701/50

[56] References Cited

U.S. PATENT DOCUMENTS

| | | | |
|---|---|---|---|
| 5,081,838 | 1/1992 | Miyaoka et al. | 37/348 X |
| 5,092,408 | 3/1992 | Tatara et al. | 172/2 |
| 5,477,677 | 12/1995 | Krnavek | 60/414 |
| 5,598,648 | 2/1997 | Moriya et al. | 37/348 |
| 5,899,008 | 5/1999 | Cobo et al. | 37/348 |
| 5,911,506 | 6/1999 | Nakamura et al. | 37/348 |

FOREIGN PATENT DOCUMENTS

| | | |
|---|---|---|
| 4-117054 | 10/1992 | Japan . |
| 5-38371 | 5/1993 | Japan . |
| 7-35105 | 2/1995 | Japan . |
| 8-296603 | 11/1996 | Japan . |

*Primary Examiner*—Robert E. Pezzuto
*Attorney, Agent, or Firm*—Morrison & Foerster LLP

[57] ABSTRACT

A control method and apparatus for construction machine. A joint type arm mechanism is provided on a construction machine which is driven by a cylinder type actuator, which is itself connected to a fluid pressure circuit having a pump. The cylinder type actuator's delivery pressure is variable in response to the movement of an operation member and is operated by the delivery pressure from the pump. The delivery pressure of the pump is maintained greater than or equal to a predetermined value even when the operation member is in a neutral position for the cylinder type actuator, so that, even immediately after the movement of the arm mechanism is initiated, a response delay of the pump or an increase of the dead zone can be suppressed and the accuracy of the completed movement of a working member can be enhanced.

3 Claims, 13 Drawing Sheets

METHOD AND DEVICE FOR CONTROLLING CONSTRUCTION MACHINE

TECHNICAL FIELD

This invention relates to a construction machine such as a hydraulic excavator for excavating the ground, and more particularly to a control method and a control apparatus for a construction machine of the type mentioned.

A construction machine such as a hydraulic excavator has a construction wherein it includes, for example, as schematically shown in FIG. 13, an upper revolving unit 100 with an operator cab (cabin) 600 provided on a lower traveling body 500 having caterpillar members 500A, and further, a joint type arm mechanism composed of a boom 200, a stick 300 and a bucket 400 is provided on the upper revolving unit 100.

And, based on expansion/contraction displacement information of the boom 200, stick 300 and bucket 400 obtained, for example, by stroke sensors 210, 220 and 230, the boom 200, stick 300 and bucket 400 can be driven suitably by hydraulic cylinders 120, 121 and 122, respectively, to perform an excavating operation while the advancing direction of the bucket 400 or the posture of the bucket 400 is kept fixed so that control of the position and the posture of a working member such as the bucket 400 can be performed accurately and stably.

By the way, in such a conventional hydraulic excavator as described above, when an operation (raking) of moving a top of the bucket 400 linearly such as, for example, a horizontal leveling operation is performed automatically by a controller, solenoid valves (control valve mechanisms) in a hydraulic circuit which supplies and discharges working oil to and from the hydraulic cylinders 120, 121 and 122 are electrically feedback controlled to control the expansion/contraction operations of the hydraulic cylinders 120, 121 and 122 to control the postures of the boom 200, stick 300 and bucket 400.

In this instance, the hydraulic cylinders 120, 121 and 122 are connected to the hydraulic circuits and are operated by a delivery pressure from a pump, and when an operator operates an operation lever, supply or discharge of the working oil to or from the hydraulic cylinders 120 to 122 is performed through the hydraulic circuit so that the boom 200, stick 300 and bucket 400 operate.

And, immediately before driving of the joint type arm mechanism is started, the operation lever is disposed in a neutral position (non-driving position), and the pump mentioned above is in a condition (idling condition) wherein it little delivers the working oil. If the operation lever is operated from the condition described, then the delivery pressure of the pump gradually rises in response to the operation amount of the operation lever.

Consequently, immediately after the operation lever is operated from the idling condition of the pump to start automatic control (immediately after driving is started), since the delivery pressure of the pump does not exhibit a sufficient rise, a response delay of the pump occurs, and besides, due to the fact that the pump load is lower than the loads to the hydraulic cylinders 120 to 122, the dead zone is increased, resulting in deterioration of the posture control accuracy of the bucket 400. Accordingly, it is difficult to improve the finish accuracy of a horizontally leveled surface or the like by the bucket 400 immediately after driving is started.

The present invention has been made in view of such a subject as described above, and it is an object of the present invention to provide a control method and a control apparatus for a construction machine by which, even immediately after driving of an arm mechanism is started, a response delay of a pump or an increase of a dead zone is suppressed to achieve improvement in the finish accuracy by a working member.

SUMMARY OF INVENTION

In order to attain the object described above, according to the present invention, a control method for a construction machine wherein a joint type arm mechanism provided on a construction machine body is driven by a cylinder type actuator which is connected to a fluid pressure circuit having a pump, whose delivery pressure is variable in response to an operation amount by an operation member, and is operated by the delivery pressure from the pump, is characterized in that the delivery pressure of the pump is maintained equal to or higher than a predetermined value also when the operation member is in a non-driving position for the cylinder type actuator.

In the control method for a construction machine described above, also when the operation member is in the non-driving position for the cylinder type actuator, the delivery pressure is maintained equal to or higher than the predetermined value, and consequently, even immediately after the operation member is operated from the non-driving position (immediately after driving is started) in order to operate the joint type arm mechanism, a sufficient pump delivery pressure is obtained and a response delay of the pump or an increase of the dead zone can be suppressed.

Accordingly, even immediately after driving of the arm mechanism is started, deterioration of the posture control accuracy of the working member can be prevented, and the finish accuracy by the working member can be enhanced remarkably.

Meanwhile, a control apparatus for a construction machine of the present invention is characterized in that it comprises a construction machine body, a joint type arm mechanism pivotally mounted at an end portion thereof on the construction machine body and having a working member at the other end side thereof, a cylinder type actuator mechanism for performing an expansion/contraction operation to drive the arm mechanism, an operation member for operating the arm mechanism through the cylinder type actuator mechanism, a fluid pressure circuit having a pump whose delivery pressure is variable in response to an operation amount by the operation member for supplying and discharging working fluid to and from the cylinder type actuator mechanism to cause the cylinder type actuator mechanism to perform an expansion/contraction operation, detection means for detecting whether or not the operation member is in a non-driving position for the cylinder type actuator mechanism, and pump control device for maintaining, when it is detected by the detection means that the operation member is in the non-driving position for the cylinder type actuator mechanism, the delivery pressure of the pump equal to or higher than a predetermined value.

It is to be noted that the pump control device described above may be constructed such that it maintains the delivery pressure of the pump equal to or higher than the predetermined value if it is detected by the detection device that the operation member is in the non-driving position for the cylinder type actuator mechanism and it is detected that a control starting triggering operation by a control starting triggering operation member has been performed.

Further, the pump control device described above may be constructed such that it varies the delivery pressure to be maintained in response to a condition of a load acting upon the cylinder type actuator mechanism, and in this instance, the pump control device may be constructed such that it includes storage device in which the maintained delivery pressure to be varied in response to the condition of the load acting upon the cylinder type actuator mechanism.

In the control apparatus for a construction machine of the present invention described above, if it is detected by the detection device described above that the operation member is in the non-driving position for the cylinder type actuator mechanism, the delivery pressure of the pump is maintained equal to or higher than the predetermined value by the pump control device, and consequently, even immediately after the operation member is operated from the non-driving position (immediately after driving is started) in order to operate the joint type arm mechanism, a sufficient pump delivery pressure is obtained and a response delay of the pump or an increase of the dead zone can be suppressed.

Accordingly, also in this instance, even immediately after driving of the arm mechanism is started, deterioration of the posture control accuracy of the working member can be prevented, and the finish accuracy by the working member can be enhanced remarkably.

It is to be noted that, where the pump control device maintains the delivery pressure of the pump equal to or higher than the predetermined value when it is detected by the detection means described above that the operation member is in the non-driving position for the cylinder type actuator mechanism and it is detected that a control starting triggering operation by the control starting triggering operation member has been performed, whether or not the control operation of the pump control device for maintaining the delivery pressure of the pump equal to or higher than the predetermined value when the operation member is in the non-driving position can be selected by a control starting triggering operation by the control starting triggering operation member.

Accordingly, only when an operator or the like wants, the control operation by the pump control device can be performed, and the delivery pressure of the pump need not be held to an unnecessarily high pressure condition and efficient operation can be achieved.

Further, where the pump control device varies the delivery pressure to be maintained in response to a condition of the load acting upon the cylinder type actuator mechanism, an increase of the dead zone which arises from the fact that the pump load is lower than the load to the cylinder type actuator mechanism can be suppressed with certainty, and consequently, the control apparatus for a construction machine contributes very much to enhancement of the finish accuracy by the working member.

In this instance, where the maintained delivery pressure to be varied in response to the condition of the load acting upon the cylinder type actuator mechanism is stored in advance in the storage means, the pump control device can obtain an optimum delivery pressure to be maintained of the pump and perform variation control of the delivery pressure of the pump only if it reads out the delivery pressure to be maintained corresponding to the condition of the load acting upon the cylinder type actuator mechanism from the storage device .

DETAILED DESCRIPTION OF THE INVENTION

In the following, an embodiment of the present invention is described with reference to the drawings.

Figure 1:
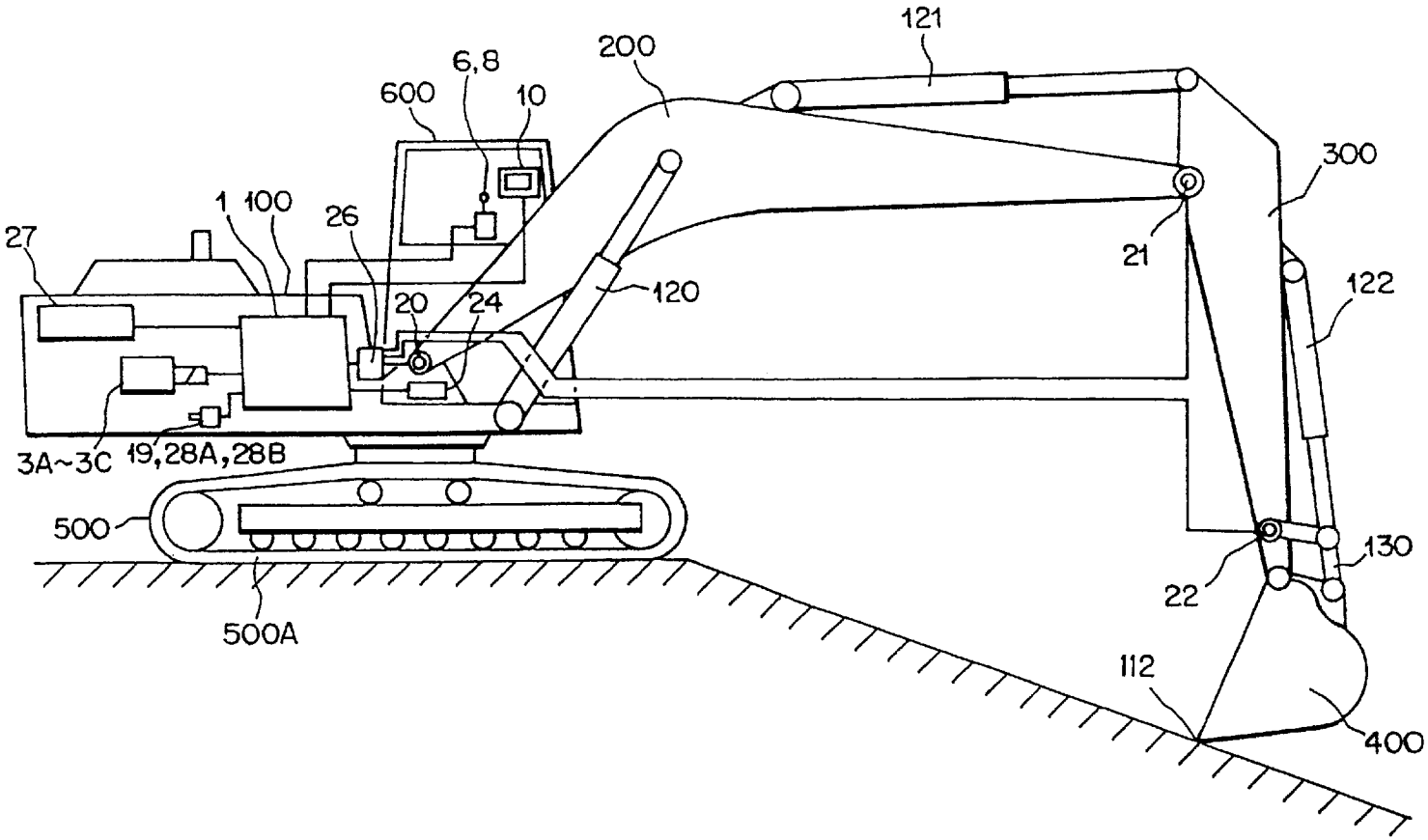
FIG. 1 is a schematic view of a hydraulic excavator on which a control apparatus according to an embodiment of the present invention is mounted.

A hydraulic excavator as a construction machine according to the present embodiment includes, for example, as schematically shown in FIG. 1, an upper revolving unit (construction machine body) 100 with an operator cab 600 for revolving movement in a horizontal plane on a lower traveling body 500 which has caterpillar members 500A on the left and right thereof.

A boom (arm member) 200 having one end connected for swinging motion is provided on the upper revolving unit 100, and a stick (arm member) 300 connected at one end thereof for swinging motion by a joint part is provided on the boom 200.

A bucket working member) 400 which is connected at one end thereof for swinging motion by a joint part and can excavate the ground with a tip thereof and accommodate earth and sand therein is provided on the stick 300.

In this manner, a joint type arm mechanism which is mounted at one end portion thereof for pivotal motion on the upper revolving unit 100 and has the bucket 400 on the other end side thereof and further has the boom 200 and the stick 300 as a pair of arm members connected to each other by the joint part is composed of the boom 200, stick 300 and bucket 400.

Further, a boom hydraulic cylinder 120, a stick hydraulic cylinder 121 and a bucket hydraulic cylinder 122 (in the following description, the boom hydraulic cylinder 120 may be referred to as boom cylinder 120 or merely as cylinder 120, the stick hydraulic cylinder 121 may be referred to as stick cylinder 121 or merely as cylinder 121, and the bucket hydraulic cylinder 122 may be referred to as bucket cylinder 122 or merely as cylinder 122) as cylinder type actuators are provided.

Here, the boom cylinder 120 is connected at one end thereof for swinging motion to the upper revolving unit 100 and is connected at the other one end thereof for swinging motion to the boom 200, or in other words, the boom cylinder 120 is interposed between the upper revolving unit 100 and the boom 200, such that, as the distance between the opposite end portions is expanded or contracted, the boom 200 can be swung with respect to the upper revolving unit 100.

The stick cylinder 121 is connected at one end thereof for swinging motion to the boom 200 and connected at the other one end thereof for swinging motion to the stick 300, or in other words, the stick cylinder 121 is interposed between the boom 200 and the stick 300, such that, as the distance between the opposite end portions is expanded or contracted, the stick 300 can be swung with respect to the boom 200.

The bucket cylinder 122 is connected at one end thereof for swinging motion to the stick 300 and connected at the other one end thereof for swinging motion to the bucket 400, or in other words, the bucket cylinder 122 is interposed between the stick 300 and the bucket 400, such that, as the distance between the opposite end portions thereof is expanded or contracted, the bucket 400 can be swung with respect to the stick 300. It is to be noted that a linkage 130 is provided at a free end portion of the bucket hydraulic cylinder 122.

In this manner, a cylinder type actuator mechanism having a plurality of cylinder type actuators for driving the arm mechanism by performing expanding or contracting operations is composed of the cylinders 120 to 122 described above.

It is to be noted that, thoughnot shown in the figure, also hydraulic motors for driving the left and right caterpillar members 500A and a revolving motor for driving the upper revolving unit 100 to revolve are provided.

Figure 2:
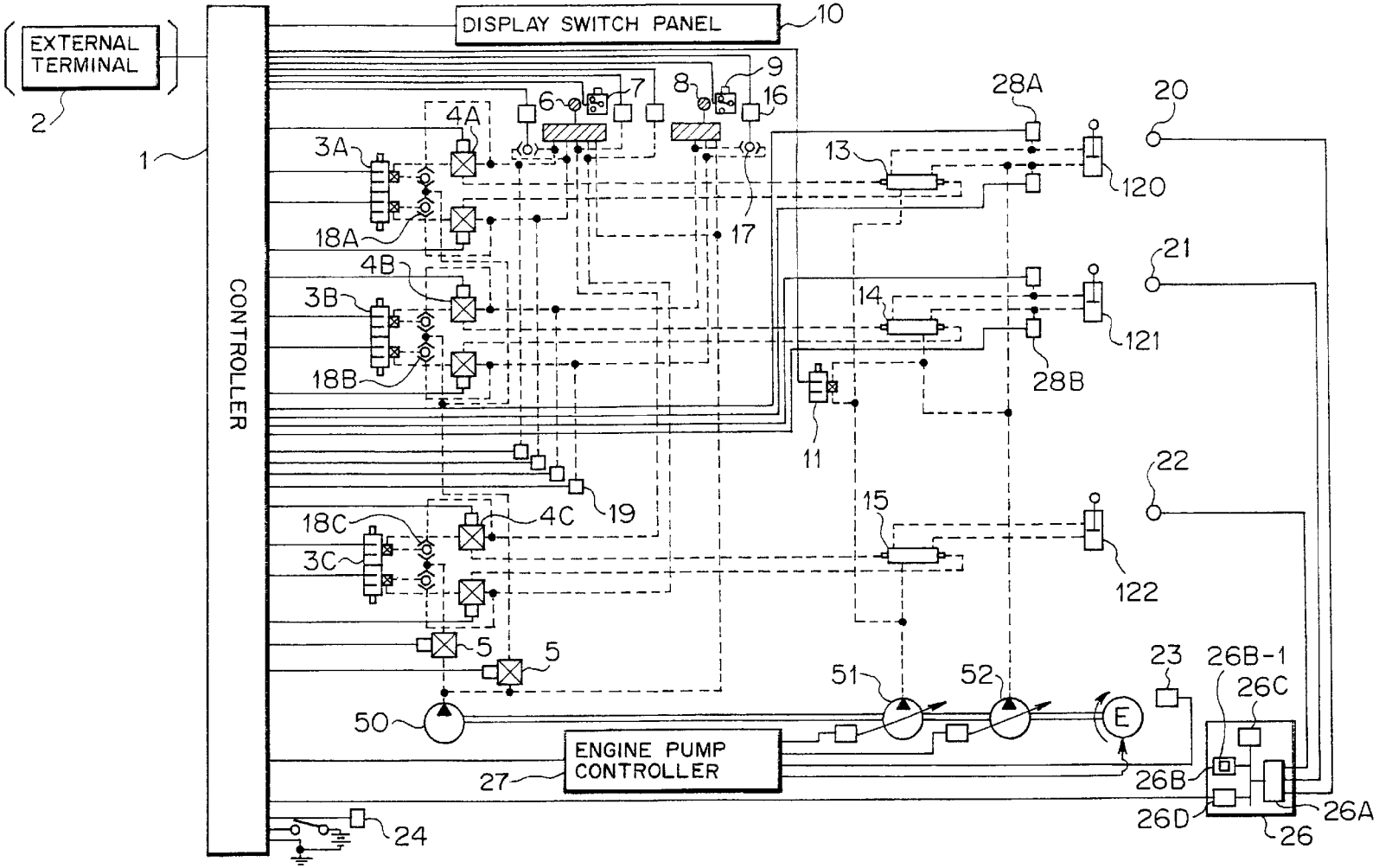
FIG. 2 is a view schematically showing a general construction (electric system and hydraulic system) of the control apparatus according to the embodiment of the present invention.

By the way, as shown in FIG. 2, a hydraulic circuit (fluid pressure circuit) for the cylinders 120 to 122, the hydraulic motors and the revolving motor described above is provided, and in addition to pumps 51 and 52 of the variable delivery pressure type which are driven by an engine E, a boom main control valve (control valve) 13, a stick main control valve (control valve) 14, a bucket main control valve (control valve) 15 and so forth are interposed in the hydraulic circuit. The pumps 51 and 52 of the variable delivery pressure type are each constructed such that the camp plate angle (tilt angle) is controlled by an engine pump controller 27 which will be hereinafter described so that the delivery pressure of working oil to the hydraulic circuit can be varied.

It is to be noted that, where each line which interconnects different components is a solid line in FIG. 2, this represents that this line is an electric system, but where each line which interconnects different components is a broken line, this represents that the line is a hydraulic system.

Further, in order to control the main control valves 13, 14 and 15, a pilot hydraulic circuit is provided, and in addition to a pilot pump 50 driven by the engine E, solenoid proportional valves 3A, 3B and 3C, solenoid directional switch valves 4A, 4B and 4C, selector valves 18A, 18B and 18C and so forth are interposed in the pilot hydraulic circuit.

In the hydraulic excavator of the present embodiment, a controller 1 for controlling the main control valves 13, 14 and 15 via the solenoid proportional valves 3A, 3B and 3C to control the boom 200, the stick 300 and the bucket 400 in response to a mode in which they should be controlled so that they may have desired expansion/contraction displacements is provided. It is to be noted that the controller 1 is composed of a microprocessor, memories such as a ROM and a RAM, suitable input/output interfaces and so forth.

To the controller 1, detection signals (including setting signals) from various sensors are inputted, and the controller 1 executes the control described above based on the detection signals from the sensors. It is to be noted that such control by the controller 1 is called semiautomatic control, and even during excavation under the semiautomatic control (semiautomatic excavation mode), it is possible to manually effect fine adjustment of a bucket angle and an aimed slope face height.

As such a semiautomatic control mode (semiautomatic excavation mode) as described above, a bucket angle control mode (refer to FIG. 8), a slope face excavation mode (bucket tip linear excavation mode or raking mode; refer to FIG. 9), a smoothing mode which is a combination of the slope face excavation mode and the bucket angle control mode (refer to FIG. 10), a bucket angle automatic return mode (automatic return mode; refer to FIG. 11) and so forth are available.

Figure 8:
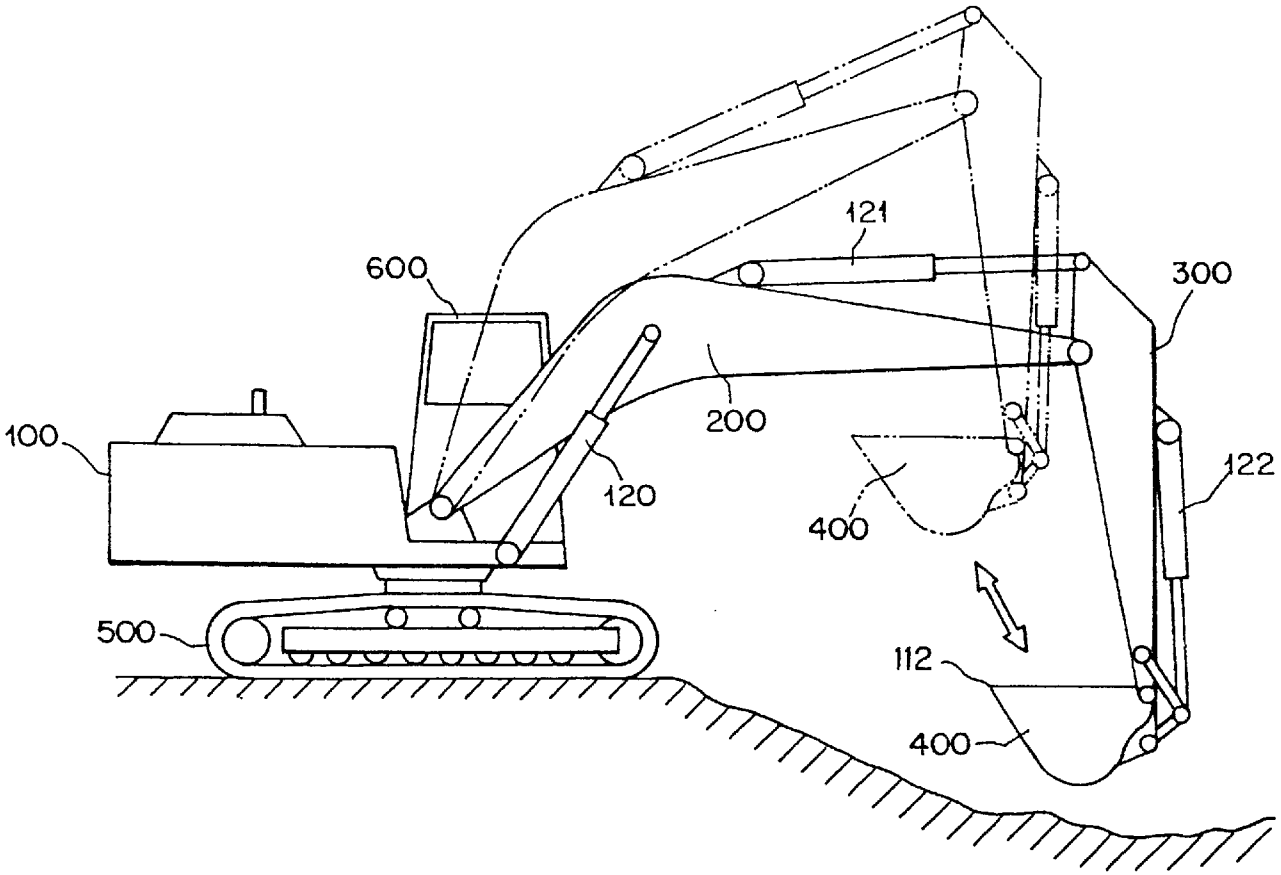
FIG. 8 is a side elevational view schematically showing the hydraulic excavator in order to explain operation of the hydraulic excavator according to the present embodiment.

Here, the bucket angle control mode is a mode in which the angle (bucket angle) of the bucket 400 with respect to the horizontal direction (vertical direction) is always kept constant even if the stick 300 and the boom 200 are moved as shown in FIG. 8, and this mode is executed if a bucket angle control switch on a monitor panel 10 which will be hereinafter described is switched ON. It is to be noted that this mode is cancelled when the bucket 400 is moved manually, and a bucket angle at a point of time when the bucket 400 is stopped is stored as a new bucket holding angle.

Figure 9:
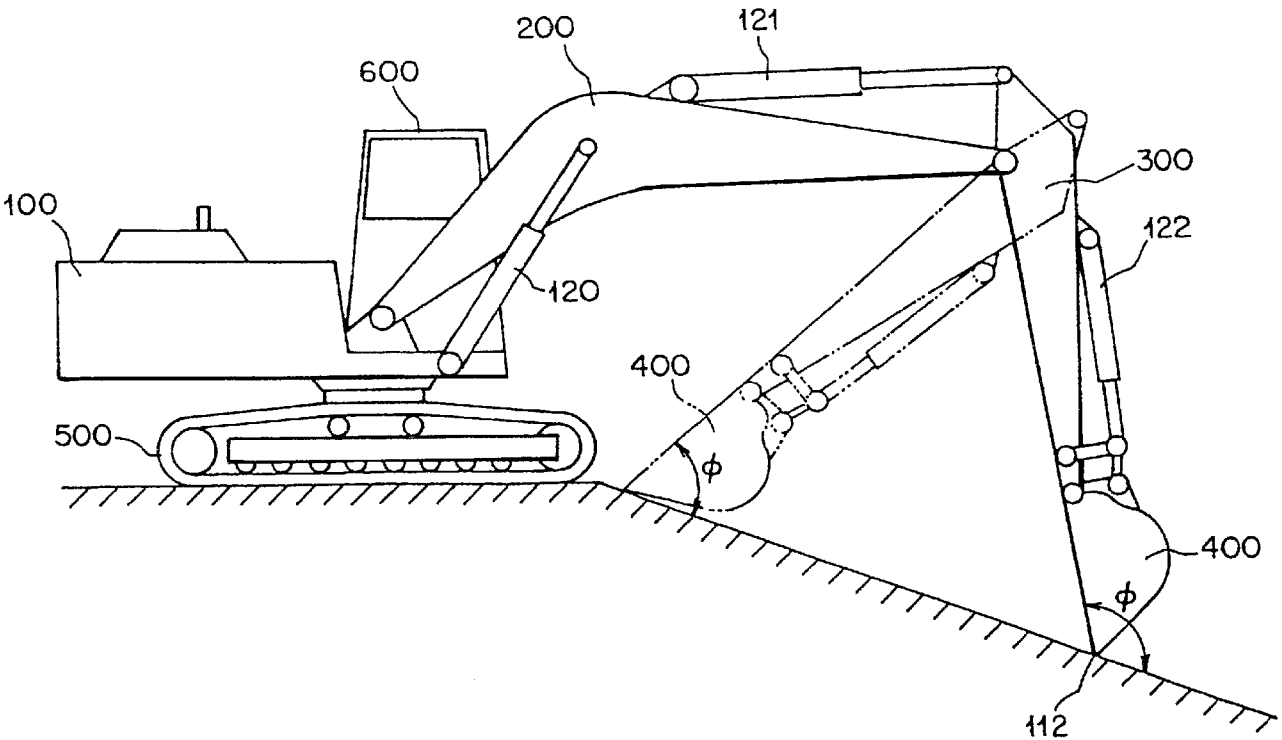
FIG. 9 is a side elevational view schematically showing the hydraulic excavator in order to explain operation of the hydraulic excavator according to the present embodiment.

The slope face excavation mode is a mode in which a tip 112 (which may sometimes be referred to as bucket tip 112) of the bucket 400 moves linearly as shown in FIG. 9. However, the bucket cylinder 122 does not move. Further, the bucket angle $\phi$ varies as the bucket 400 moves.

Figure 10:
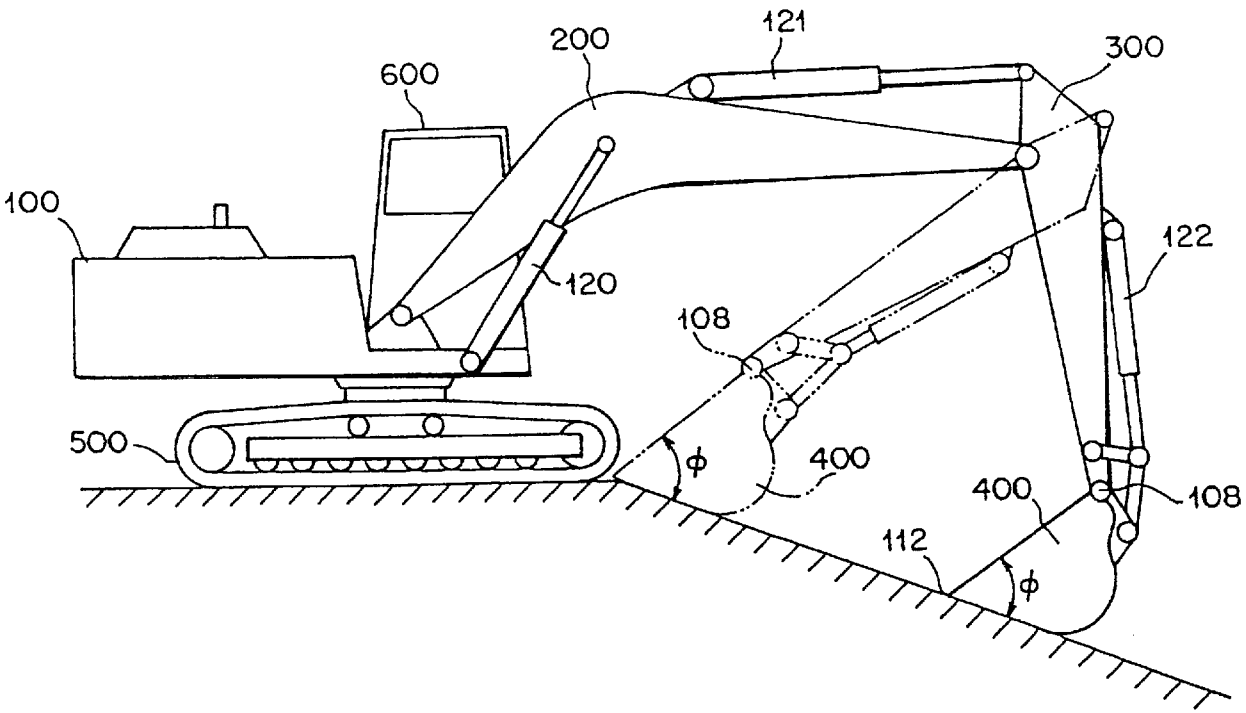
FIG. 10 is a side elevational view schematically showing the hydraulic excavator in order to explain operation of the hydraulic excavator according to the present embodiment.

The slope face excavation mode+bucket angle control mode (smoothing mode) is a mode in which the tip 112 of the bucket 400 moves linearly and also the bucket angle $\phi$ is kept constant during excavation as shown in FIG. 10.

Figure 11:
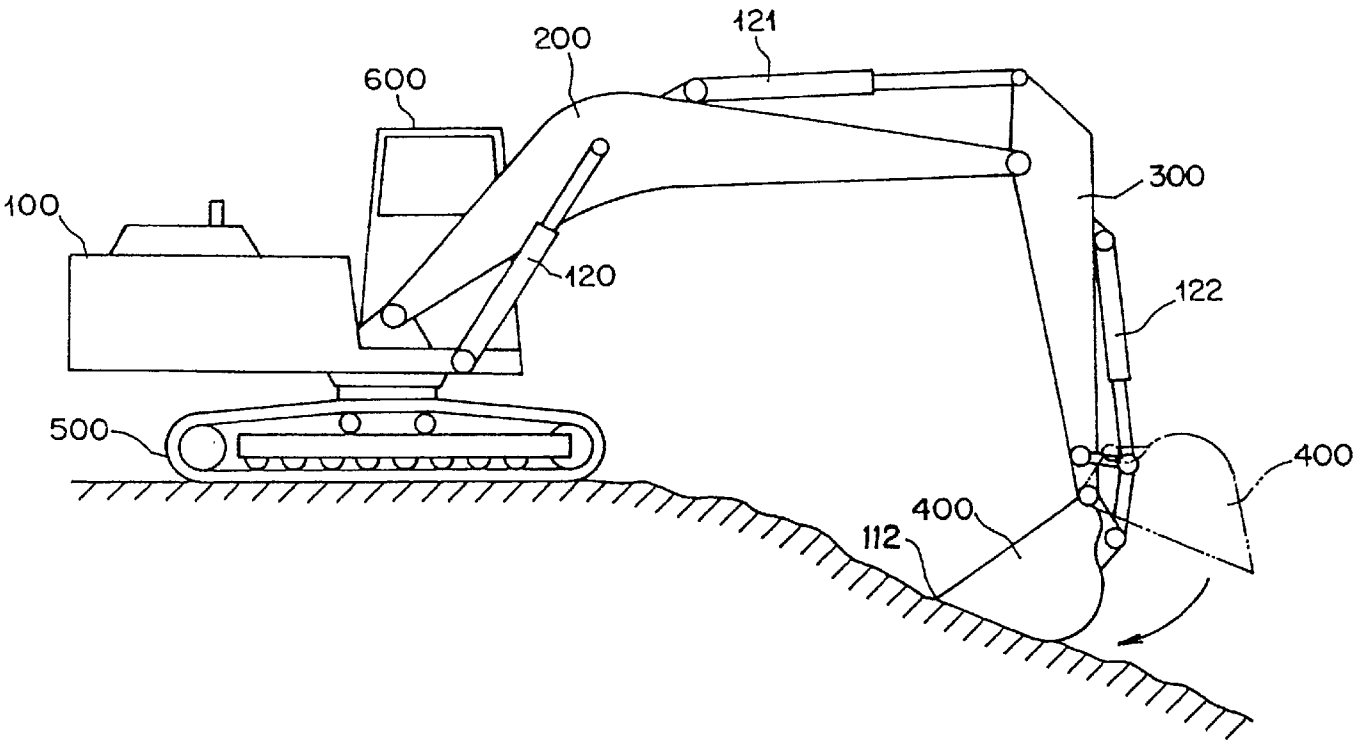
FIG. 11 is a side elevational view schematically showing the hydraulic excavator in order to explain operation of the hydraulic excavator according to the present embodiment.

The bucket automatic return mode is a mode in which the bucket angle is automatically returned to an angle set in advance as shown in FIG. 11, and the return bucket angle is set by the monitor panel 10. This mode is started when a bucket automatic return start switch 7 on a boom/bucket operation lever 6 is switched ON. This mode is cancelled at a point of time when the bucket 400 returns to the angle set in advance.

The slope face excavation mode and the smoothing mode described above are entered when a semiautomatic control switch on the monitor panel 10 is switched ON and a slope face excavation switch 9 on a stick operation lever 8 is switched ON and besides both or either one of the stick operation lever 8 and the boom/bucket operation lever 6 is moved. It is to be noted that the aimed slope face angle is set by a switch operation on the monitor panel 10.

Further, in the slope face excavation mode and the smoothing mode, the operation amount of the stick operation lever 8 provides a bucket tip moving velocity in a parallel direction to the aimed slope face angle, and the operation amount of the boom/bucket operation lever 6 provides a bucket tip moving velocity in the perpendicular direction. Accordingly, if the stick operation lever 8 is moved, then the bucket tip 112 starts its linear movement along the aimed slope face angle, and fine adjustment of the aimed slope face height by a manual operation can be performed by moving the boom/bucket operation lever 6 during excavation.

Furthermore, in the slope face excavation mode and the smoothing mode, not only the bucket angle during excavation can be adjusted finely, but also the aimed slope face height can be changed, by operating the boom/bucket operation lever 6.

It is to be noted that, in the present system, also a manual mode is possible, and in this manual mode, not only operation equivalent to that of a conventional hydraulic excavator is possible, but also coordinate indication of the bucket tip 112 is possible.

Also a service mode for performing service maintenance of the entire semiautomatic system is prepared, and this service mode is enabled by connecting an external terminal 2 to the controller 1. And, by this service mode, adjustment of control gains, initialization of various sensors and so forth are performed.

By the way, as the various sensors connected to the controller 1, as shown in FIG. 2, pressure switches 16, pressure sensors 19, 28A and 28B, resolvers (angle sensors, posture detection means) 20 to 22, a vehicle inclination angle sensor 24 and so forth are provided. Further, to the controller 1, the engine pump controller 27, an ON-OFF switch (bucket automatic return start switch described above) 7, another ON-OFF switch (slope face excavation switch described hereinabove) 9, the monitor panel (display switch panel) 10 with an aimed slope face angle setting unit are connected. It is to be noted that the external terminal 2 is connected to the controller 1 upon adjustment of the control gains, initialization of the sensors and so forth.

The engine pump controller 27 receives engine speed information from an engine speed sensor 23 and controls the cam plate angles (tilt angles) of the engine E and the pumps 51 and 52 of the variable delivery pressure type described above. The engine pump controller 27 can communicate coordination information with the controller 1. The pressure sensors 19 are attached to pilot pipes connected from the operation levers 6 and 8 for expansion/contraction of the stick 300 and for upward/downward movement of the boom 200 to the main control valves 13, 14 and 15 and detect pilot hydraulic pressures in the pilot pipes. Since the pilot hydraulic pressures in such pilot pipes are varied by the operation amounts of the operation levers 6 and 8, by measuring the hydraulic pressures, the controller 1 can estimate the operation amounts of the operation levers 6 and 8 based on the measured hydraulic pressures.

The pressure sensors 28A and 28B detect expansion/contraction conditions of the boom cylinder 120 and stick cylinder 121, respectively, and the load conditions acting upon the cylinders 120 and 121 can be detected by the pressure sensors 28A and 28B, respectively.

It is to be noted that, upon the semiautomatic control described above, the stick operation lever 8 is used to determine the bucket tip moving velocity in a parallel direction with respect to a set excavation slant face, and the boom/bucket operation lever 6 is used to determine the bucket tip moving velocity in the perpendicular direction with respect to the set slant face. Accordingly, when the stick operation lever 8 and the boom/bucket operation lever 6 are operated simultaneously, the moving direction and the moving velocity of the bucket tip are determined by a composite vector in the parallel and perpendicular directions with respect to the set slant face.

The pressure switches 16 are attached to the pilot pipes for the operation levers 6 and 8 for the boom 200, stick 300 and bucket 400 with selector valves 17 or the like interposed therebetween and are used to detect whether or not the operation levers 6 and 8 are in a neutral condition. In particular, when the operation lever 6 or 8 is in the neutral condition, the output of the pressure switch 16 is OFF, but when the operation lever 6 or 8 is used, the output of the pressure switch 16 is ON. It is to be noted that the pressure switches 16 for detection of a neutral condition are used also for detection of an abnormal condition of the pressure sensors 19 and for switching between the manual/semiautomatic modes.

The resolver 20 is provided at a pivotally mounted portion (joint part) of the boom 200 on the construction machine body 100 at which the posture of the boom 200 can be monitored and functions posture detection means for detecting the posture of the boom 200. The resolver 21 is provided at a pivotally mounted portion (joint part) of the stick 300 on the boom 200 at which the posture of the stick 300 can be monitored and functions as posture detection means for detecting the posture of the stick 300. Further, the resolver 22 is provided at a linkage pivotally mounted portion at which the posture of the bucket 400 can be monitored and functions as posture detection means for detecting the posture of the bucket 400. By those resolvers 20 to 22, angle detection means for detecting the posture of the arm mechanism in angle information is composed.

A signal converter 26 converts angle information obtained by the resolver 20 into expansion/contraction displacement information of the boom cylinder 120, converts angle information obtained by the resolver 21 into expansion/contraction displacement information of the stick cylinder 121, and converts angle information obtained by the resolver 22 into expansion/contraction displacement information of the bucket cylinder 122, that is, converts angle information obtained by the resolvers 20 to 22 into corresponding expansion/contraction displacement information of the cylinders 120 to 122.

To this end, the signal converter 26 includes an input interface 26A for receiving signals from the resolvers 20 to 22, a memory 26B which includes a lookup table 26B-1 for storing expansion/contraction displacement information of the cylinders 120 to 122 corresponding to angle information obtained by the resolvers 20 to 22, a main arithmetic unit (CPU) 26C which can calculate the expansion/contraction displacement information of the cylinders 120 to 122 corresponding to angle information obtained by the resolvers 20 to 22 and communicate the cylinder expansion/contraction displacement information with the controller 1, and an output interface 26D for sending out the cylinder expansion/contraction displacement information from the CPU 26C.

The expansion/contraction displacement information $\lambda bm$, $\lambda st$ and $\lambda bk$ of the cylinders 120 to 122 corresponding to the angle information $\theta bm$, $\theta st$ and $\theta bk$ obtained by the resolvers 20 to 22 described above can be calculated using the cosine theorem in accordance with the following expressions (1) to (3):

$$\lambda bm=(L_{101/102}^2+L_{101/111}^2-2L_{101/102}\cdot L_{101/111}\cos(\theta bm+Axbm))^{1/2} \quad (1)$$

$$\lambda st=(L_{103/104}^2+L_{104/105}^2-2L_{103/104}\cdot L_{104/105}\cos\theta st)^{1/2} \quad (2)$$

$$\lambda bk=(L_{106/107}^2+L_{107/109}^2-2L_{106/107}\cdot L_{107/109}\cos\theta bk)^{1/2} \quad (3)$$

Here, in the expressions above, $L_{i/j}$ represents a fixed length, Axbm represents a fixed angle, and the suffix i/j to L has information between the nodes i and j. For example, $L_{101/102}$ represents the distance between the node 101 and the node 102. It is to be noted that the node 101 is determined as the origin of the xy coordinate system (refer to FIG. 7).

Naturally, each time the angle information θbm, θst and θbk is obtained by the resolvers 20 to 22, the expressions above may be calculated by arithmetic means (for example, the CPU 26C). In this instance, the CPU 26C forms the arithmetic means which calculates, based on the angle information obtained by the resolvers 20 to 22, expansion/contraction displacement information of the cylinders 120 to 122 corresponding to the angle information by calculation.

It is to be noted that signals obtained by the conversion by the signal converter 26 are utilized not only for feedback control upon semiautomatic control but also to measure coordinates for measurement/indication of the position of the tip 112 of the bucket 400.

The position of the bucket tip 112 (the position may be hereinafter referred to as bucket tip position 112) in the semiautomatic system is calculated using a certain point of the upper revolving unit 100 of the hydraulic excavator as the origin. However, when the upper revolving unit 100 is inclined in the front linkage direction, it is necessary to rotate the coordinate system for control calculation by an angle by which the vehicle is inclined. The vehicle inclination angle sensor 24 is used to correct the coordinate system for an amount of the rotation of the coordinate system.

While the solenoid proportional valves 3A to 3C control the hydraulic pressures supplied from the pilot pump 50 in response to electric signals from the controller 1 and the controlled hydraulic pressures act upon the main control valves 13, 14 and 15 through the switch valves 4A to 4C or the selector valves 18A to 18C to control the spool positions of the main control valves 13, 14 and 15 so that aimed cylinder velocities may be obtained, if the control valves 4A to 4C are set to the manual mode side, then the cylinders 120 to 122 can be controlled manually.

It is to be noted that a stick confluence control proportional valve 11 adjusts the confluence ratio of the two pumps 51 and 52 in order to obtain an oil amount corresponding to an aimed cylinder velocity.

Further, the ON-OFF switch (slope face excavation switch) 9 described hereinabove is mounted on the stick operation lever 8, and as an operator operates the switch 9, a semiautomatic mode is selected or not selected. Then, if a semiautomatic mode is selected, then the tip 112 of the bucket 400 can be moved linearly.

Furthermore, the ON-OFF switch (bucket automatic return start switch) 7 described hereinabove is mounted on the boom/bucket operation lever 6, and as an operator switches on the switch 7, the bucket 400 can be automatically returned to an angle set in advance.

Safety valves 5 are provided to switch the pilot pressures to be supplied to the solenoid proportional valves 3A to 3C, and only when the safety valves 5 are in an ON state, the pilot pressures are supplied to the solenoid proportional valves 3A to 3C. Accordingly, when some failure occurs or in a like case in the semiautomatic control, automatic control of the linkage can be stopped rapidly by switching the safety valves 5 to an OFF state.

The speed of the engine E is different depending upon the position of the engine throttle set by an operator [the position is set by operating a throttle dial (not shown)], and further, even if the position of the engine throttle is fixed, the engine speed varies depending upon the load. Since the pumps 50, 51 and 52 are directly connected to the engine E, if the engine speed varies, then also the pump discharges (pump delivery pressures) vary, and consequently, even if the spool positions of the main control valves 13, 14 and 15 are fixed, the cylinder velocities are varied by the variation of the engine speed. In order to correct this, the engine speed sensor 23 is mounted, and when the engine speed is low, the aimed moving velocity of the tip 112 of the bucket 400 is set slow.

The monitor panel 10 with an aimed slope face angle setting unit (which may sometimes be referred to simply as monitor panel 10) is not only used as a setting unit for the aimed slope face angle α (refer to FIGS. 7 and 12) and the bucket return angle, but also used as an indicator for coordinates of the bucket tip 12, the slope face angle measured or the distance between coordinates of two points measured. It is to be noted that the monitor panel 10 is provided in the operator cab 600 together with the operation levers 6 and 8.

In particular, in the system according to the present embodiment, the pressure sensors 19 and the pressure switches 16 are incorporated in conventional pilot hydraulic lines to detect operation amounts of the operation levers 6 and 8 and feedback control is effected using the resolvers 20, 21 and 22 while multiple freedom degree feedback control can be effected independently for each of the cylinders 120, 121 and 122. Consequently, the requirement for addition of an oil unit such as a pressure compensation valve is unnecessary. Further, an influence of inclination of the upper revolving unit 100 is corrected using the vehicle inclination angle sensor 24, and the solenoid proportional valves 3A to 3C are utilized in order to drive the cylinders 120, 121 and 122 with electric signals from the controller 1. It is to be noted that an operator can select a mode arbitrarily using the manual/semiautomatic mode change-over switch 9 and besides can set an aimed slope face angle.

In the following, a control algorithm of the semiautomatic system performed by the controller 1 is described. The control algorithm of the semiautomatic control mode (except the bucket automatic return mode) effected by the controller 1 is substantially such as illustrated in FIG. 4.

In particular, the moving velocity and the moving direction of the tip 122 of the bucket 400 are first calculated based on information of the aimed slope face set angle, the pilot hydraulic pressures for controlling the stick cylinder 121 and the boom cylinder 120, the vehicle inclination angle and the engine speed. Then, aimed velocities of the cylinders 120, 121 and 122 are calculated based on the calculated information (moving velocity and moving direction of the tip 112 of the bucket 400). In this instance, the information of the engine speed is required to determine an upper limit to the cylinder velocities.

Figure 3:
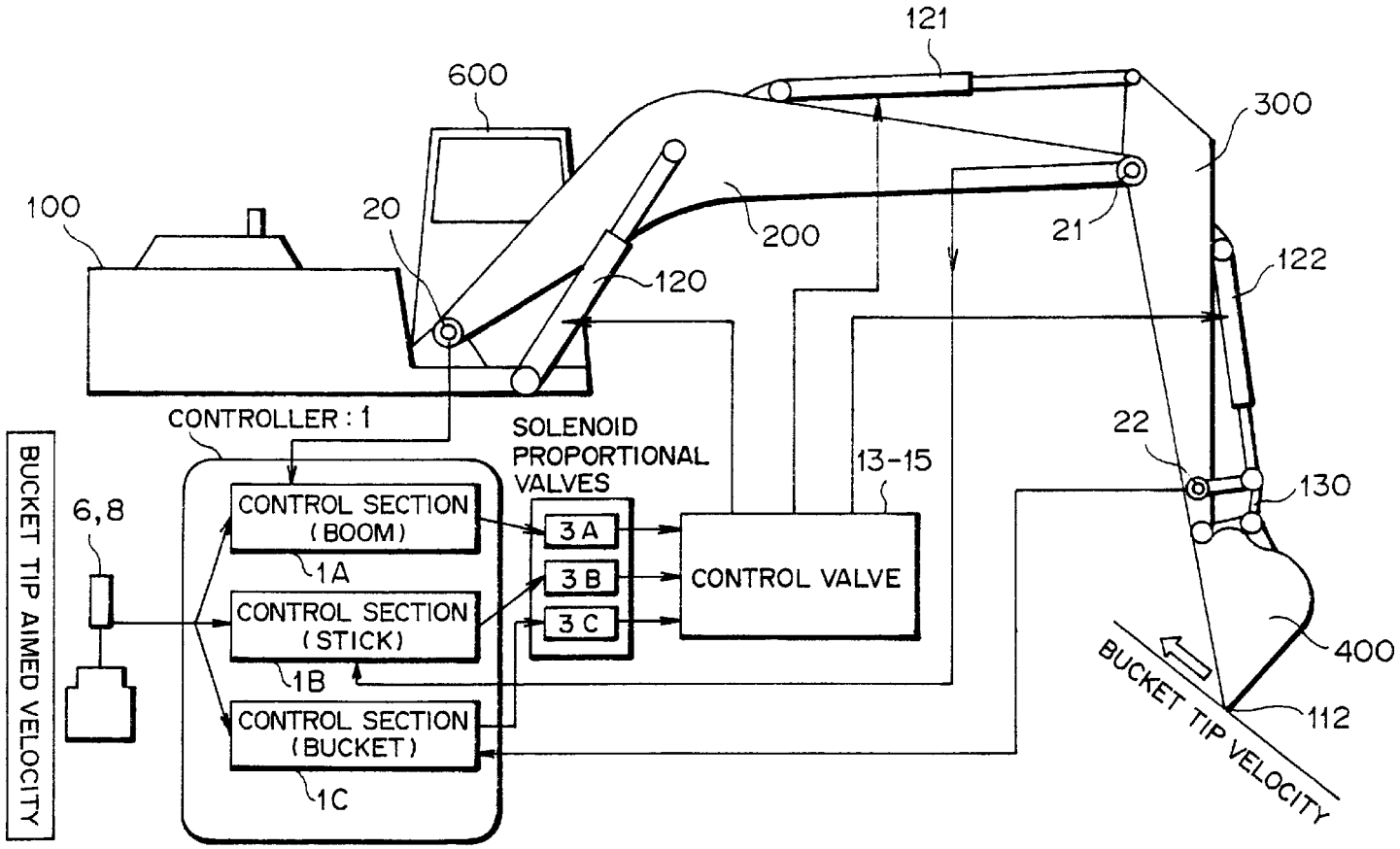
FIG. 3 is a block diagram schematically showing a general construction of the control apparatus according to the embodiment of the present invention.
Figure 4:
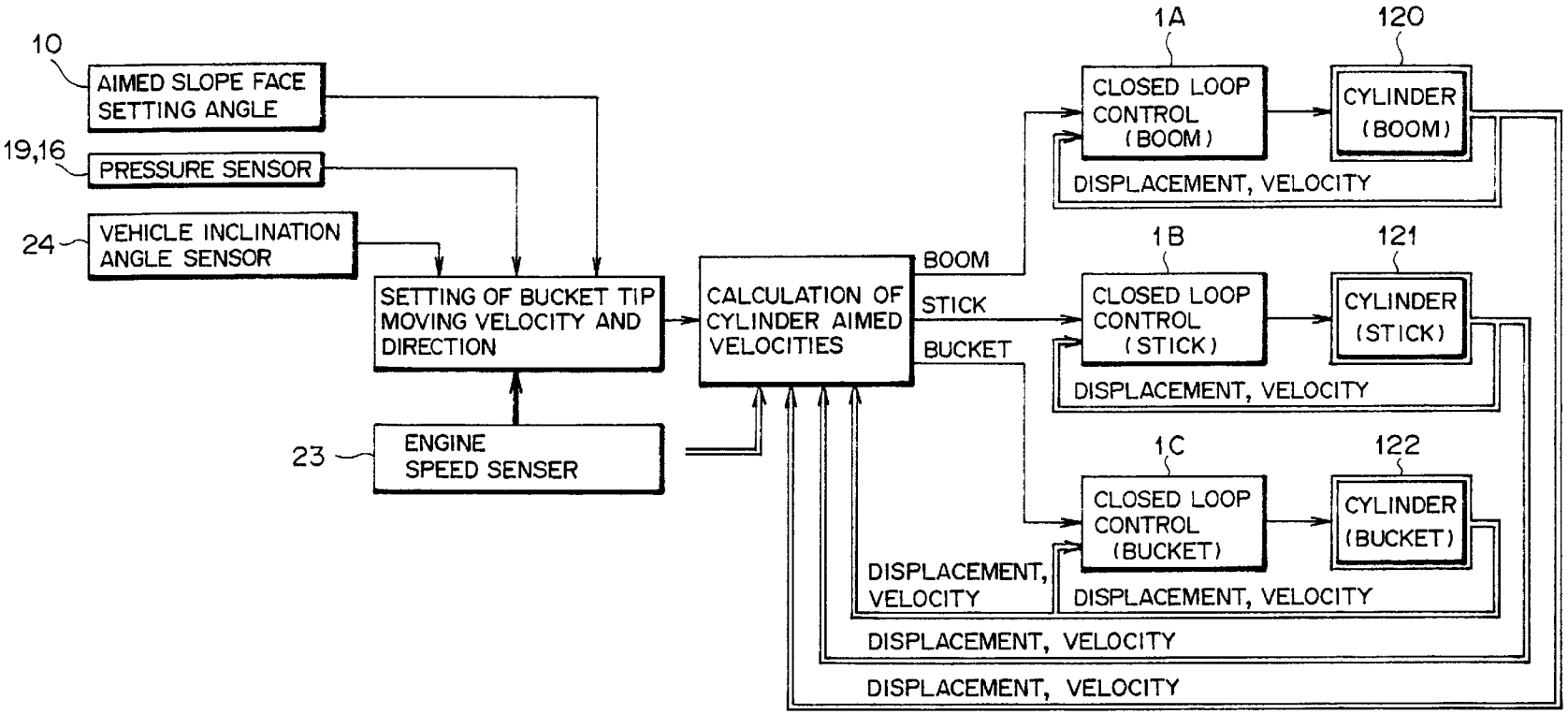
FIG. 4 is a block diagram for explaining a functional construction of the entire control apparatus according to the embodiment of the present invention.

Further, the controller 1 includes, as shown in FIGS. 3 and 4, control sections 1A, 1B and 1C provided independently of each other for the cylinders 120, 121 and 122, and the controls are constructed as independent control feedback loops as shown in FIG. 4 so that they may not interfere with each other.

Figure 5:
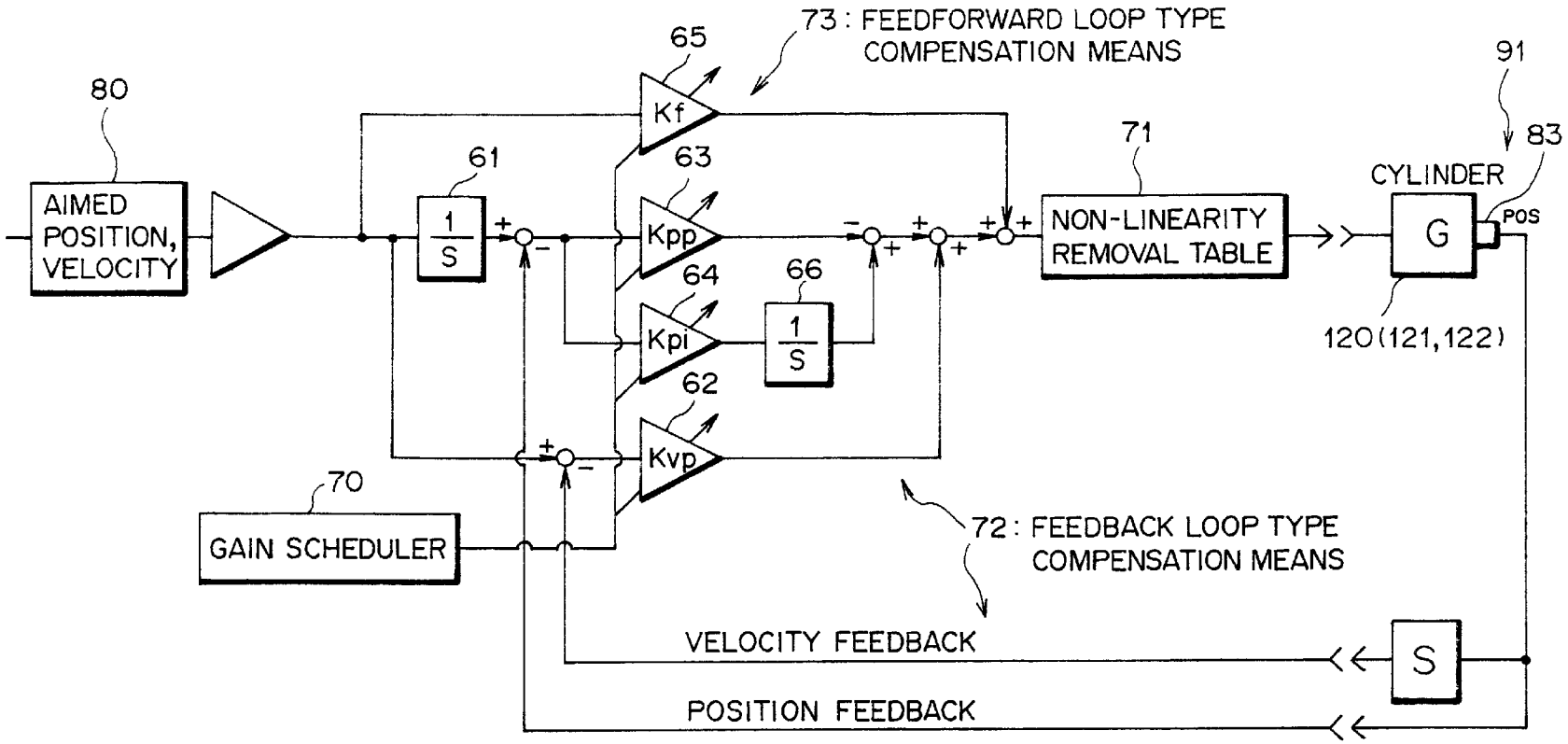
FIG. 5 is a control block diagram of essential part of the control apparatus according to the embodiment of the present invention.

Here, essential part of the control apparatus of the present embodiment is described. The compensation construction in the closed loop controls shown in FIG. 4 has, in each of the control sections 1A, 1B and 1C, a multiple freedom degree construction including a feedback loop and a feedforward, loop with regard to the displacement and the velocity as shown in FIG. 5, and includes feedback loop type compensation means 72 having a variable control gain (control parameter), and feed forward loop type compensation means 73 having a variable control gain (control parameter).

In particular, if an aimed velocity is given, then feedback loop processes according to a route wherein a deviation between the aimed velocity and velocity feedback information is multiplied by a predetermined gain Kvp (refer to reference numeral 62), another route wherein the aimed velocity is integrated once (refer to an integration element 61 of FIG. 5) and a deviation between the aimed velocity integration information and displacement feedback information is multiplied by a predetermined gain Kpp (refer to reference numeral 63) and a further route wherein the deviation between the aimed velocity integration information and the displacement feedback information is multiplied by a predetermined gain Kpi (refer to reference numeral 64) and further integrated (refer to reference numeral 66) are performed by the feedback loop type compensation means 72 while, by the feedforward loop type compensation means 73, a feedforward loop process by a route wherein the aimed velocity is multiplied by a predetermined gain Kf (refer to reference numeral 65) is performed.

Of the processes mentioned, the feedback loop processes are described in more detail. The present apparatus includes, as shown in FIG. 5, operation information detection means 91 for detecting operation information of the cylinders 120 to 122, and the controller 1 receives the detection information from the operation information detection means 91 and aimed operation information (for example, an aimed moving velocity) set by aimed value setting means 80 as input information and sets and outputs control signals so that the arm members such as the boom 200 and the bucket (working member) 400 may exhibit aimed operation conditions. Further, the operation information detection means 91 particularly is cylinder position detection means 83 which can detect positions of the cylinders 120 to 122, and in the present embodiment, the cylinder position detection means 83 is composed of the resolvers 20 to 22 and the signal converter 26 described hereinabove.

It is to be noted that the values of the gains Kvp, Kpp, Kpi and Kf can be changed by a gain scheduler 70.

Further, while a non-linearity removal table 71 is provided to remove non-linear properties of the solenoid proportional valves 3A to 3C, the main control valves 13 to 15 and so forth, a process in which the non-linearity removal table 71 is used is performed at a high speed by a computer by using a table lookup technique.

By the way, in the control apparatus of the present embodiment, the engine pump controller 27 and the controller 1 cooperate with each other to provide functions of variably controlling the delivery pressures of the pumps 51 and 52 (functions as pump control means). Main ones of the functions are a function ① and another function ② described below:

Function ①): function of variably controlling the delivery pressures of the pumps 51 and 52 in response to an operation amount by the stick operation lever (operation member) 8. The function of controlling, when the operation lever 6 or 8 is operated from a condition (idling condition) wherein the operation lever 6 or 8 is disposed at its neutral position (non-driving position) and the pumps 51 and 52 little deliver the working oil, the cam plate angles of the pumps 51 and 52 so that the delivery pressures of the pumps 51 and 52 may gradually rise in response to the operation amount of the operation lever 6 or 8.

Function ②: function of controlling the cam plate angles of the pumps 51 and 52 so that the delivery pressures of the angle pumps 51 and 52 may be held equal to or higher than a predetermined value (to a high pressure condition) in response to a control starting triggering operation by a pushbutton switch 8*a* (refer to FIG. 6) provided for the stick operation lever 8, a signal from a neutral position detecting sensor (detection means) 8*b* for detecting whether or not the stick operation lever 8 is in a non-driving position (neutral position; in a position in which the pumps 51 and 52 are in an idling condition) for the cylinders 120 and 121 and signals from the pressure sensors 28A and 28B (load conditions of the cylinders 120 and 121). More particularly, the function of controlling, when the stick operation lever 8 is in its neutral position and the pushbutton switch 8*a* is depressed, the cam plate angles of the pumps 51 and 52 so that delivery pressures corresponding to the load conditions of the cylinders 120 and 121 may be maintained.

The latter function ② which is a characteristic function of the present invention is described in more detail with reference to FIG. 6.

Figure 6:
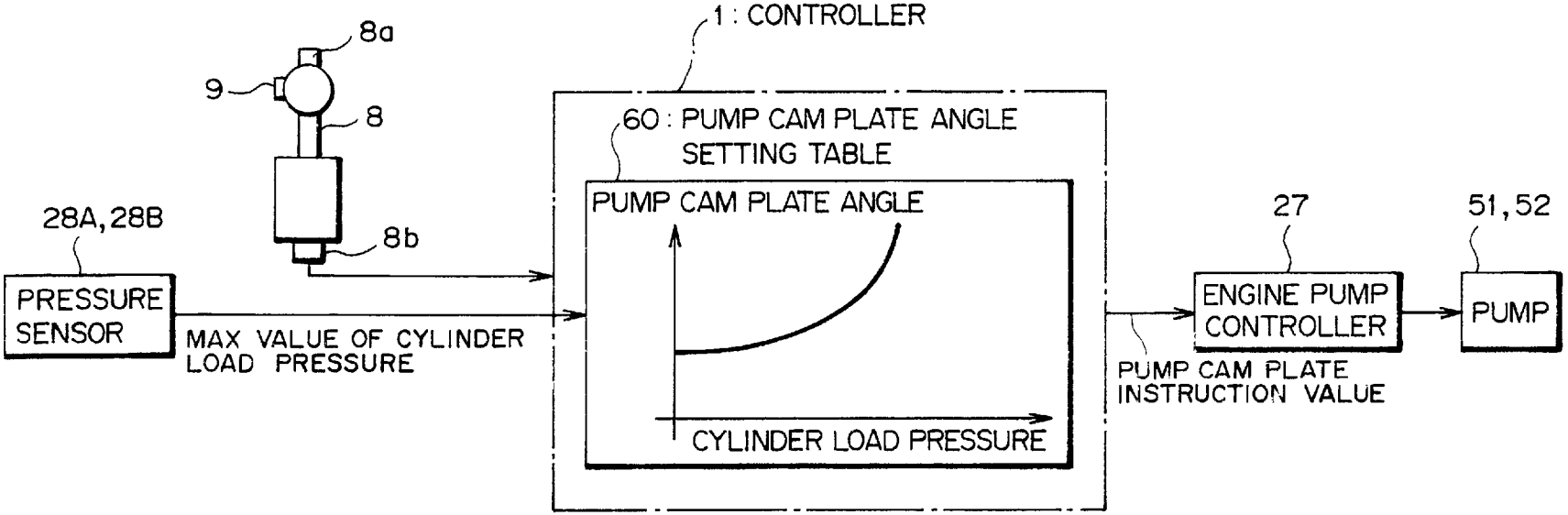
FIG. 6 is a block diagram for explaining a characteristic function of the control apparatus according to the embodiment of the present invention and construction of essential part relating to the function.

As shown in FIG. 6, in the present embodiment, the neutral position detecting sensor (detection means) 8*b* for detecting whether the stick operation lever 8 is in its non-driving position (neutral position) for the cylinders 120 and 121 and the pushbutton switch (control starting triggering operation member) 8*a* which is operated when semiautomatic control is to be started are provided for the stick operation lever 8.

The controller 1 has a pump cam plate angle setting table (storage means) which will be hereinafter described, and when it is detected by the neutral position detecting sensor 8*b* that the stick operation lever 8 is in its neutral position and the pushbutton switch 8*a* is depressed (control starting triggering operation), the controller 1 outputs a pump cam plate instruction value to the engine pump controller 27 to control the delivery pressures of the cylinders 120 and 121 so that the delivery pressures may be held at delivery pressures (high pressure condition) corresponding to the load conditions of the cylinders 120 and 121 (maximum values of the cylinder load pressures) detected by the pressure sensors 28A and 28B.

Then, the engine pump controller 27 which receives the pump cam plate instruction value from the controller 1 actually performs control of the pumps 51 and 52 by adjusting them so that the cam plate angles of them may be equal to the pump cam plate instruction to maintain the delivery pressures of the pumps 51 and 52 equal to or higher than the predetermined value.

The pump cam plate angle setting table 60 is provided to output a pump cam plate angle (pump cam plate instruction value) corresponding to the load conditions of the cylinders 120 and 121 (maximum values of the loads in the cylinder driving direction) detected by the pressure sensors 28A and 28B, and is stored in a memory (for example, a ROM or a RAM), which composes the controller 1, in advance to allow a pump cam plate angle corresponding to a maximum value of a cylinder load pressure to be read out by using a table lookup technique.

In the pump cam plate angle setting table 60, the pump cam plate angle is set such that the delivery pressure of each of the pumps 51 and 52 increases as the maximum values of the cylinder load pressures detected by the pressures sensors 28A and 28B increase as shown, for example, in FIG. 6.

It is to be noted that, while, in the present embodiment, the pushbutton switch 8*a* as a control starting triggering operation member and the neutral position detecting sensor 8*b* are provided for the stick operation member 8, they may be provided for the boom/bucket operation lever 6. Further, while, in the present embodiment, the pump cam plate angle setting table 60 and the function of outputting a pump cam plate instruction value based on the table 60 are provided in the controller 1 the table 60 and the pump cam plate instruction value outputting function may be provided in the engine pump controller 27.

Figure 12:
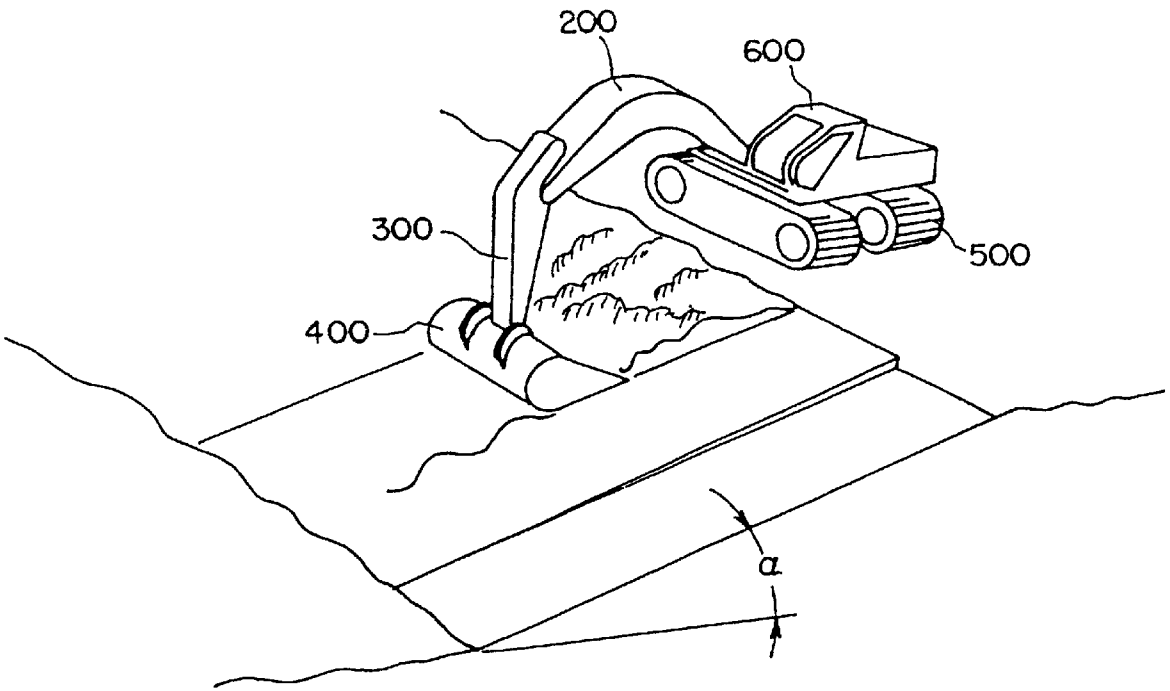
FIG. 12 is a side elevational view schematically showing the hydraulic excavator in order to explain operation of the hydraulic excavator according to the present embodiment.
Figure 13:
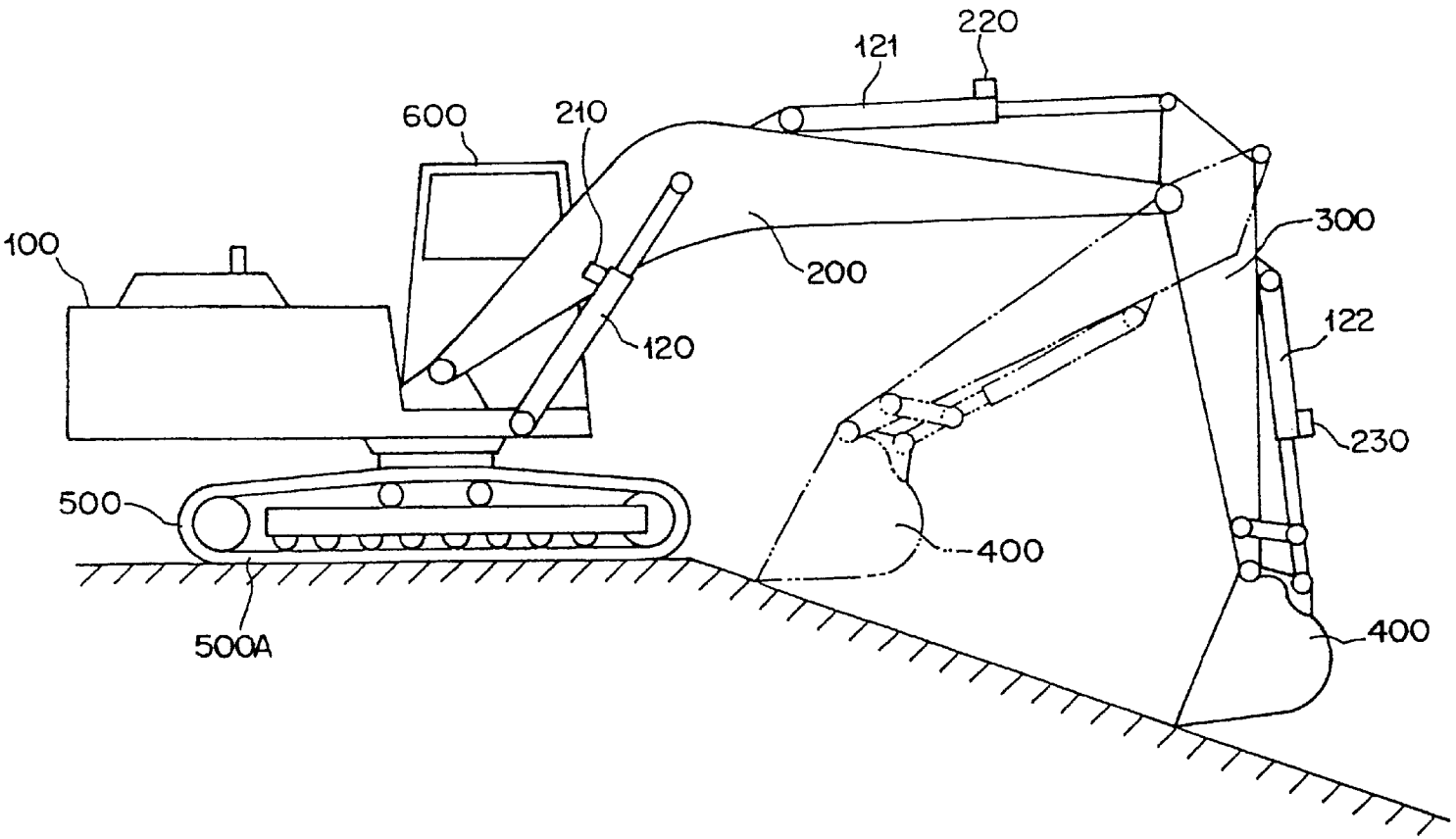
FIG. 13 is a side elevational view schematically showing a general construction of a conventional hydraulic excavator.

In the present embodiment having such a construction as described above, when such a slope face excavating operation of an aimed slope face angle a as shown in FIG. 12 is performed semi-automatically using the hydraulic excavator, in the system according to the present invention, such semiautomatic control functions as described above can be realized by an electronic hydraulic system which automatically adjusts the composite moving amount of the boom 200 and the stick 300 in accordance with the excavating velocity in contrast with a conventional system of manual control.

In particular, detection signals (including setting information of an aimed slope face angle) are inputted from the various sensors to the controller 1 mounted on the hydraulic excavator, and the controller 1 controls the main control valves 13, 14 and 15 through the solenoid proportional valves 3A, 3B and 3C based on the detection signals from the sensors (including detection signals of the resolvers 20 to 22 received via the signal converter 26) to effect such control that the boom 200, stick 300 and bucket 400 may exhibit desired expansion/contraction displacements to effect such semiautomatic control as described above.

Then, upon the semiautomatic control, the moving velocity and the moving direction of the tip 112 of the bucket 400 are calculated from information of the aimed slope face set angle, the pilot hydraulic pressures which control the stick cylinder 121 and the boom cylinder 120, the vehicle inclination angle and the engine speed, and aimed velocities of the cylinders 120, 121 and 122 are calculated based on the calculated information (moving velocity and moving direction of the tip 112 of the bucket 400). In this instance, an upper limit to the cylinder velocities is determined based on the information of the engine speed. Further, the controls are performed as the feedback loops independent of each other for the cylinders 120, 121 and 122 and do not interfere with each other.

Particularly in the control apparatus of the present embodiment, when it is detected by the neutral position detecting sensor 8*b* that the stick operation lever 8 is in its neutral position and it is detected that a depression operation of the pushbutton switch 8*a* has been performed, a pump cam plate angle corresponding to the maximum value of the cylinder load pressures is read out from the pump cam plate angle setting table 60 by the controller 1 and outputted as a pump camplate instruction value to the engine pump controller 27 as described above with reference to FIG. 6.

Consequently, the cam plate angles of the pumps 51 and 52 which are in a condition immediately before starting of driving of the system are adjusted by the engine pump controller 27 so that the delivery pressures thereof are controlled so as to be maintained equal to or higher than a predetermined delivery pressure corresponding to the maximum value of the cylinder load pressures.

It is to be noted that the setting of the aimed slope face angle in the semiautomatic system can be performed by a method which is based on inputting of a numerical value by switches on the monitor panel 10, a two point coordinate inputting method, or an inputting method by a bucket angle, and similarly, for the setting of the bucket return angle in the semiautomatic system, a method which is based on inputting of a numerical value by the switches on the monitor panel 10 or a method which is based on bucket movement is performed. For all of them, known techniques are used.

Further, the semiautomatic control modes described above and the controlling methods are performed in the following manner based on cylinder expansion/contraction displacement information obtained by conversion by the signal converter 26 of the angle information detected by the resolvers 20 to 22.

First, in the bucket angle control mode, the length of the bucket cylinder 122 is controlled so that the angle (bucket angle) $\phi$ defined between the bucket 400 and the x axis may be fixed at each arbitrary position. In this instance, the bucket cylinder length $\lambda$bk is determined if the boom cylinder length $\lambda$bm, the stick cylinder length $\lambda$st and the angle $\phi$ mentioned above is determined.

In the smoothing mode, since the bucket angle $\phi$ is kept fixed, the bucket tip position 112 and a node 108 move inparallel. First, a case wherein the node 108 moves in parallel to the x axis (horizontal excavation) is considered. In particular, in this instance, the coordinates of the node 108 in the linkage posture when excavation is started are represented by $(x_{108}, y_{108})$, and the cylinder lengths of the boom cylinder 120 and the stick cylinder 121 in the linkage posture in this instance are calculated and the velocities of the boom 200 and the stick 300 are calculated so that $x_{108}$ may move horizontally. It is to be noted that the moving velocity of the node 108 depends upon the operation amount of the stick operation lever 8.

On the other hand, where parallel movement of the node 108 is considered, the coordinates of the node 108 after the very short time At are represented by $(x_{108}+\Delta x, y_{108})$. $\Delta x$ is a very small displacement which depends upon the moving velocity. Accordingly, by taking $\Delta x$ into consideration of $x_{108}$, aimed lengths of the boom and stick cylinders after $\Delta t$ can be calculated.

In the slope face excavation mode, control similar to that in the smoothing mode may be performed. However, the point which moves is changed from the node 108 to the bucket tip position 112, and further, the control takes it into consideration that the bucket cylinder length is fixed.

Figure 7:
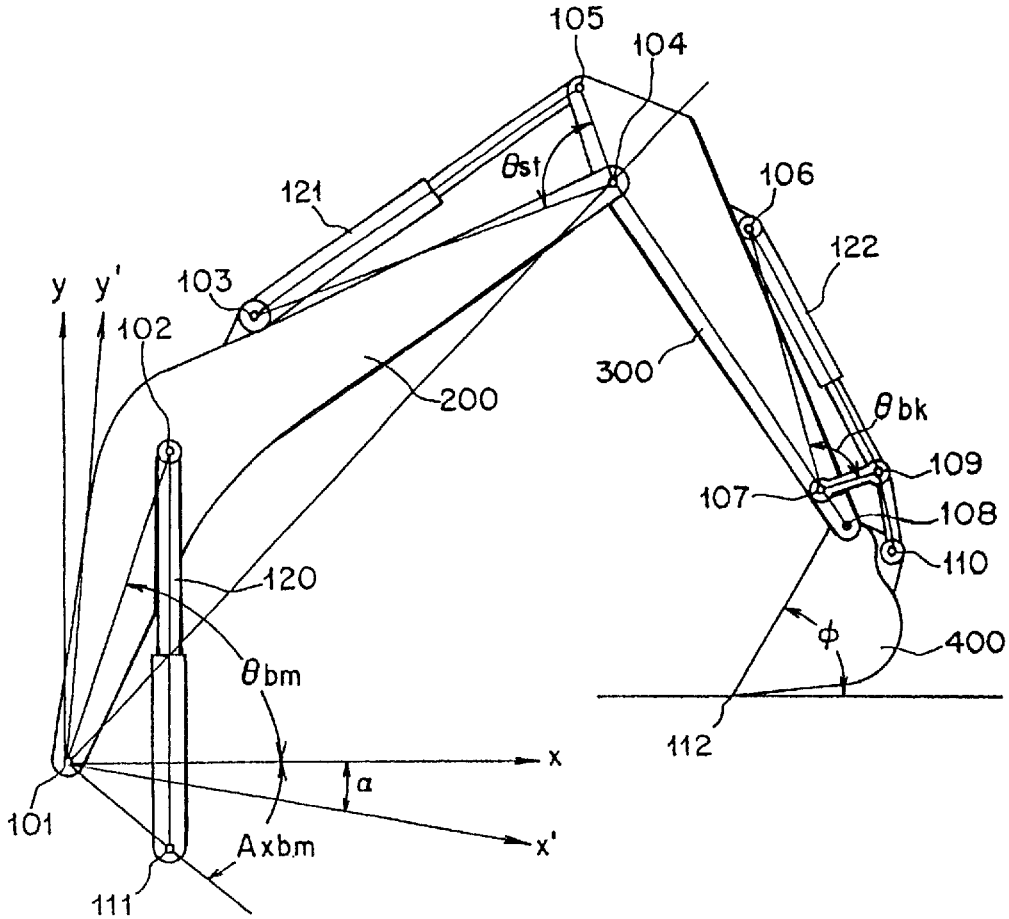
FIG. 7 is a side elevational view showing operating parts (a joint type arm mechanism and a bucket) of the hydraulic excavator according to the present embodiment.

Further, in correction of a finish inclination angle by the vehicle inclination sensor 24, calculation of the front linkage position is performed on the xy coordinate system whose origin is a node 101 of FIG. 7. Accordingly, if the vehicle body is inclined with respect to the xy plane, then the xy coordinates are rotated, and the aimed inclination angle with respect to the ground surface is varied. In order to correct this, the vehicle inclination angle sensor 24 is mounted on the vehicle, and when it is detected by the vehicle inclination angle sensor 24 that the vehicle body is rotated by $\beta$ with respect to the xy plane, the aimed inclination angle should be corrected by replacing it with a value obtained by adding $\beta$ to it.

Prevention of deterioration of the control accuracy by the engine speed sensor 23 is such as follows. In particular, with regard to correction of the aimed bucket tip velocity, the aimed bucket tip velocity depends upon the positions of the operation levers 6 and 8 and the engine speed. Meanwhile, since the hydraulic pumps 51 and 52 are directly connected to the engine E, when the engine speed is low, also the pump discharges are small and the cylinder velocities are low. Therefore, the engine speed is detected, and the aimed bucket tip velocity is calculated so as to conform with the variation of the pump discharges.

Meanwhile, with regard to correction of the maximum values of the aimed cylinder velocities, correction is performed taking it into consideration that the aimed cylinder velocities are varied by the posture of the linkage and the aimed slope face inclination angle and that, when the pump discharges decrease as the engine speed decreases, also the maximum cylinder velocities must be decreased. It is to be noted that, if an aimed cylinder velocity exceeds its maximum cylinder velocity, then the aimed bucket tip velocity is decreased so that the aimed cylinder velocity may not exceed the maximum cylinder velocity.

While the various control modes and the controlling methods are described above, they all employ a technique wherein they are performed based on cylinder expansion/contraction displacement information, and control contents according to this technique are publicly known. In particular, in the system according to the present embodiment, since angle information is detected by the resolvers 20 to 22 and then the angle information is converted into cylinder expansion/contraction displacement information by the signal converter 26, the known controlling technique can be used for later processing.

While the various controls are performed by the controller 1 in this manner, in the system according to the present embodiment, since, after the pushbutton switch 8*a* is depressed but immediately before driving of the system is started (for example, immediately before automatic control of linear excavation is started), the cam plate angles are adjusted so that the delivery pressures of the pumps 51 and 52 may conform to maximum values of the loads in the cylinder driving direction and the delivery pressures may be held in a high pressure condition, even immediately after the stick operation lever 8 is operated from its neutral position in order to operate the joint type arm mechanism, sufficient pump delivery pressures are obtained and response delays of the pumps or an increase of the dead zone can be suppressed with certainty. Accordingly, even immediately after driving of the arm mechanism is started, deterioration of the posture control accuracy of the bucket 400 can be prevented, and the finish accuracy of a horizontally leveled surface or the like by the bucket 400 is enhanced remarkably.

In this instance, since, in the present embodiment, it can be selected by an operation of the pushbutton switch 8*a* whether or not a controlling operation by the function ② described hereinabove should be performed, a controlling operation by the function ② can be performed only when an operator or the like wants, and the delivery pressure of each of the pumps 51 and 52 need not be held to an unnecessarily high pressure condition. Consequently, there is an advantage also in that efficient operation of the system can be achieved.

Further, since, in the present embodiment, the delivery pressures to be maintained are varied in response to the load conditions (maximum values of the cylinder load pressures) acting upon the cylinders 120 and 121 by the controller 1 (engine pump controller 27), an increase of the dead zone which arises from the fact that the pump load is lower than the loads to the cylinders 120 and 121 can be suppressed with a higher degree of certainty, and the present invention contributes to further enhancement of the finish accuracy of a horizontally leveled surface or the like by the bucket 400.

In this instance, where the maintained delivery pressures to be varied are stored as the table 60 in accordance with the maximum value of the cylinder load pressure in advance, there is an advantage also in that, only if the delivery pressure to be maintained corresponding to the maximum values of the cylinder load pressures is read out from the table 60, the controller 1 can obtain optimum delivery pressures to be maintained of the pumps 51 and 52 and perform variation control of the delivery pressures of the pumps 51 and 52.

Meanwhile, with the system according to the present embodiment, since angle information signals detected by the resolvers 20 to 22 are converted into cylinder displacement information by the signal converter 26 and then inputted to the controller 1, control in which cylinder expansion/contraction displacements which are used in a conventional control system are used can be executed even if an expensive stroke sensor for detecting an expansion/contraction displacement of each of the cylinders for the boom 200, stick 300 and bucket 400 as in the prior art is not used. Consequently, while the cost is suppressed low, a system which can control the position and the posture of the bucket 400 accurately and stably can be provided.

Further, since the feedback control loops are independent of each other for the cylinders 120, 121 and 122 and the control algorithm is multi-degree-of-freedom control of the displacement, velocity and feedforward, the control system can be simplified. Further, since the non-linearity of a hydraulic apparatus can be converted into linearity at a high speed by a table lookup technique, the present system contributes also to augmentation of the control accuracy.

Furthermore, since deterioration of the control accuracy by the position and load variations of the engine throttle is corrected by correcting the influence of the vehicle inclination by the inclination angle sensor 24 or reading in the engine speed, the present system contributes to realization of more accurate control.

Further, since also maintenance such as gain adjustment can be performed using the external terminal 2, also an advantage that adjustment or the like is easy can be obtained, and furthermore, since operation amounts of the operation levers 6 and 8 are determined based on variations of the pilot pressures using the pressure sensors 19 and so forth and besides a conventional open center valve hydraulic system is utilized as it is, there is an advantage that addition of a pressure compensation valve or the like is not required, and also it is possible to display the bucket tip coordinates on the real time basis on the monitor panel 10 with an aimed slope face angle setting unit. Further, due to the construction which employs the safety valve 5, also an abnormal system operation when the system is abnormal can be prevented.

It is to be noted that, while it is described in the embodiment described above that the present invention is applied to a hydraulic excavator, the present invention is not limited to this. The present invention can be applied similarly to a construction machine such as a tractor, a loader or a bulldozer only if the construction machine has a joint type arm mechanism which is driven by cylinder type actuators, and in any construction machine, similar effects to those described above can be obtained.

Further, while it is described in the embodiment described above that the fluid pressure circuit which operates the cylinder type actuators is a hydraulic circuit, the present invention is not limited to this, and any fluid pressure circuit which utilizes a liquid pressure other than working oil or a pneumatic pressure may be used only if it has a pump whose delivery pressure can be varied in response to an operation amount by an operation member, and also in this instance, similar operations and effects to those of the embodiment described above can be achieved.

Furthermore, while it is described in the embodiment described above that the engine E is, for example, a Diesel engine, the present invention can employ a prime mover (any of various internal combustion engines and so forth) only if it can drive a pump which causes a delivery pressure to act upon a fluid pressure circuit, and the engine E is not limited to a Diesel engine or the like.

And, the present invention is not limited to the embodiment described above and can be carried out in various modified forms without departing from the spirit of the present invention.

As described above, according to the present invention, since, even immediately after driving of an arm mechanism of a construction machine is started, deterioration of the posture control accuracy of a working member can be prevented and the finish accuracy of a horizontally leveled surface or the like by the working member is enhanced remarkably, a control apparatus for a construction machine of the present invention contributes very much to reduction of the working period and so forth in a desired working site such as a construction site, and it is considered that the usefulness of the control apparatus for a construction machine is very high.

What is claimed is:

1. A control method for a construction machine including (i) a joint type arm mechanism, (ii) a cylinder type actuator being operatively connected to a hydraulic circuit to drive the joint type arm mechanism, and (iii) a pump disposed in the hydraulic circuit and operable to vary delivery pressure in response to a request of an operator via an operation member, the cylinder type actuator being operable to actuate the joint type arm machine and driven by using the delivery pressure of the pump, said method comprising:

(a) detecting whether the operation member is set at a neutral position in which a driving force of the pump is no longer transmitted to the cylinder type actuator;

(b) triggering, in response to a request, of the operator, a control signal to vary the delivery pressure of the pump;

(c) monitoring a current value of loading at the cylinder type actuator; and (d) maintaining, if the operation member is set in said neutral position as the result of said detecting and in respond to said triggering, the delivery pressure of the pump at a level equal to or higher than at least one reference pressure value selected from various reference pressure values, in accordance with said monitored value of loading at the cylinder type actuator.

2. A control apparatus for a construction machine including (i) a construction main body, (ii) a joint type arm mechanism pivotally connected at one end to the construction machine body and having a working member at the other end portion, (iii) a cylinder type actuator mechanism, operatively connected with the joint type arm mechanism, for actuating the joint type arm mechanism extending and shrinking action of the actuator, (iv) an operation member, to be operated by the operator for operating the joint type arm mechanism via cylinder type actuator mechanism, (v) a hydraulic circuit having a pump being operable to vary delivery pressure to extend and shrink the cylinder type actuator upon receipt a request of the operator via the operation member, said control apparatus comprising:

(a) a detecting device for detecting whether the operation member is set at a neutral position in which a driving force of the pump is no longer transmitted to the cylinder type actuator;

(b) a triggering device for triggering, in response to a request of the operator, a control signal to vary the delivery pressure of the pump;

(c) a monitoring device for monitoring a current value of loading at the cylinder type actuator; and (d) a pump control device, operable if the operation member is set in said neutral position as the result of detection by said detecting device and responsive to the triggering by said triggering device, for maintaining the pressure value of said pump equal to or higher than at least one reference pressure value selected from various reference pressure values, in accordance with said current value of loading monitored at said monitoring device.

3. A control apparatus for a construction machine as set forth in claim 2, wherein said pump control device includes a storage device for storing various reference pressure values from which said at least one reference pressure value is to be selected by said pump control device.

* * * * *